US006287184B1

(12) United States Patent
Carpentier et al.

(10) Patent No.: US 6,287,184 B1
(45) Date of Patent: Sep. 11, 2001

(54) MARKED ABRASIVE ARTICLE

(75) Inventors: Louis R. Carpentier, Eagan, MN (US); Thomas J. Daul, New Richmond, WI (US); Alan P. Dimberg, Alexandria, MN (US); Steven J. Dobrzynski, Osceola, WI (US); David A. Kent, Rice Lake, WI (US); Jeffrey D. Vangsness, Cumberland, WI (US); William J. Whealon, Somerset, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/410,591

(22) Filed: Oct. 1, 1999

(51) Int. Cl.[7] ..... B24D 11/00

(52) U.S. Cl. ..... 451/526

(58) Field of Search ..... 451/526, 533, 451/538–539; 51/295, 809

(56) References Cited

U.S. PATENT DOCUMENTS

| | | | | |
|---|---|---|---|---|
| 2,768,886 | | 10/1956 | Twombly | 51/295 |
| 2,893,854 | | 7/1959 | Rinker et al. | 51/298 |
| 2,958,593 | | 11/1960 | Hoover et al. | 51/295 |
| 3,619,150 | | 11/1971 | Rinker et al. | 51/295 |
| 3,849,949 | | 11/1974 | Steinhauser et al. | 51/406 |
| 4,311,489 | | 1/1982 | Kressner | 51/298 |
| 4,396,403 | | 8/1983 | Ibrahim | 51/295 |
| 4,437,269 | * | 3/1984 | Shaw | 451/526 X |
| 4,609,581 | | 9/1986 | Ott | 428/100 |
| 4,652,274 | | 3/1987 | Boettcher et al. | 51/298 |
| 4,652,275 | | 3/1987 | Bloecher et al. | 51/298 |
| 4,735,632 | | 4/1988 | Oxman et al. | 51/295 |
| 4,751,138 | | 6/1988 | Tumey et al. | 428/323 |
| 4,799,939 | | 1/1989 | Bloecher et al. | 51/293 |
| 4,800,685 | | 1/1989 | Haynes, Jr. | 51/281 R |
| 4,903,440 | | 2/1990 | Larson et al. | 51/298 |
| 4,961,149 | | 10/1990 | Schneider et al. | 364/469 |
| 4,973,338 | | 11/1990 | Gaeta et al. | 51/295 |

(List continued on next page.)

FOREIGN PATENT DOCUMENTS

| | | | |
|---|---|---|---|
| 23 35 565 | 3/1974 | (DE) . | |
| 0 085 484 | 8/1983 | (EP) | B21C/51/00 |
| 0 368 654 | 5/1990 | (EP) . | |
| WO 93/12911 | 7/1993 | (WO) | B24D/11/00 |
| WO 95/11111 | 4/1995 | (WO) | B24D/3/28 |
| WO 95/11772 | 5/1995 | (WO) . | |
| WO 95/19242 | 7/1995 | (WO) | B24D/9/08 |

OTHER PUBLICATIONS

"High Performance Laser Processing for Industry", LasX Industries, Inc. Brochure, Sep. 1998.

"Lasersharp Digital Converting", LasX Industries, Inc. Brochure, Dec. 1998.

Boyle, "Lasers are on the Cutting Edge, Digitally Speaking", *DIGITAL Solutions*, Apr. 1999.

Patent Abstract of Japan Publication Number 10235480, 8–9–98.

*Primary Examiner*—Derris H. Banks
*Assistant Examiner*—Anthony Ojini
(74) *Attorney, Agent, or Firm*—Gregory D. Allen

(57) ABSTRACT

This invention encompasses abrasive articles that have a coating, typically made of at least a binder and abrasive particles, selectively removed from a portion of an exposed abrading surface of the article in order to inscribe a detectable marking on the abrasive article. Suitable coated abrasive articles include both articles that have the binder and abrasive particles sequentially coated on a backing as a make coat and deposited abrasive particles as well as articles that have the binder and abrasive particles simultaneously coated on the backing as a slurry coat. Coated abrasive articles that are particularly preferred include articles that have an exposed abrading or abrasive surface that is a textured, three-dimensional surface.

20 Claims, 1 Drawing Sheet

U.S. PATENT DOCUMENTS

| | | | | |
|---|---|---|---|---|
| 4,988,554 | | 1/1991 | Peterson et al. | 428/142 |
| 4,991,362 | | 2/1991 | Heyer et al. | 51/400 |
| 4,995,087 | | 2/1991 | Rathi et al. | 382/8 |
| 4,998,005 | | 3/1991 | Rathi et al. | 219/121.83 |
| 5,137,542 | * | 8/1992 | Buchanan et al. | 51/295 |
| 5,152,917 | | 10/1992 | Pieper et al. | 51/295 |
| 5,164,265 | | 11/1992 | Stubbs | 428/421 |
| 5,170,595 | | 12/1992 | Wiand | 51/394 |
| 5,236,472 | | 8/1993 | Kirk et al. | 51/298 |
| 5,254,194 | | 10/1993 | Ott et al. | 156/176 |
| 5,256,170 | | 10/1993 | Harmer et al. | 51/293 |
| 5,368,619 | | 11/1994 | Culler | 51/308 |
| 5,417,726 | | 5/1995 | Stout et al. | 51/293 |
| 5,435,816 | | 7/1995 | Spurgeon et al. | 51/295 |
| 5,454,750 | * | 10/1995 | Cosmano et al. | 451/526 |
| 5,580,647 | | 12/1996 | Larson et al. | 428/245 |
| 5,681,217 | * | 10/1997 | Hoopman et al. | 451/528 |
| 5,833,724 | | 11/1998 | Wei et al. | 51/307 |
| 5,840,088 | | 11/1998 | Yang et al. | 51/295 |
| 5,863,306 | | 1/1999 | Wei et al. | 51/295 |
| 5,880,430 | | 3/1999 | Wein . | |
| 5,886,319 | | 3/1999 | Preston et al. | 219/121.72 |
| 5,954,844 | | 9/1999 | Law et al. | 51/306 |
| 6,062,967 | * | 5/2000 | Calafut et al. | 451/539 X |
| 6,132,818 | | 10/2000 | Tanaka et al. . | |

* cited by examiner

MARKED ABRASIVE ARTICLE

BACKGROUND

This invention provides abrasive articles, particularly coated abrasive articles, that have a detectable marking on an exposed abrasive surface of these articles. Such detectable markings may be used for a number of different purposes including, but not limited to, source identification, abrasive grit type or size, lot identification, product description, or inventory control.

Coated abrasive articles or products are commercially available in a variety of shapes and sizes. The many shapes and sizes of coated abrasive products are often mechanically cut from a larger, abrasive-coated roll or web. Further, most of these abrasive articles or products are typically marked in some manner in order to provide a user of these products with useful information, such as identifying the manufacturer or listing the abrasive grit size, about the specific article or product.

A common way to mark these products is to print information on the surface of the product opposite to the product's abrading surface. Generally, this printing step occurs before the abrasive product is finally cut into its finished size or shape. This common practice, although widespread, has certain problems. For example, when an abrasive product is being used, the back of that product may not always be visible or accessible. For example, a hook and loop attachment or fastening system may be applied to the back surface of the abrasive product and would cover over any printing or indicia added to the back surface of those products. Further, some of the printing may be worn off or made unreadable as that product is used. Still further, some types of coated abrasive products may be made of materials or having backing materials that are difficult or impossible to legibly print on. In other situations, some of the printed information may be lost, deleted or made unreadable when the product is converted or cut to fits final shape.

In some abrading or finishing applications, ink on an abrading surface of an abrasive product may be transferred to a work piece, even in trace amounts, resulting in contamination of the workpiece in subsequent finishing operations (i.e., reduced adherence of paint to the workpiece). In other abrading or finishing applications, printing on a thin lapping abrasive product may emboss the abrasive coating and cause scratches on a workpiece.

The present invention provides both a marked abrasive article and a method of marking abrasives articles that overcome some of the problems associated with conventional ways to mark these articles.

SUMMARY OF THE INVENTION

One embodiment of this invention is an abrasive article that has a material or coating, typically made of at least a binder and abrasive particles, selectively removed from a portion of an exposed abrading surface of the article in order to inscribe a detectable marking on the abrasive article.

In another embodiment of the invention, an exposed abrading surface of a coated abrasive article has a portion of the abrading surface selectively removed to inscribe a detectable marking on the coated abrasive article, Suitable coated abrasive articles include both articles that have the binder and abrasive particles sequentially coated on a backing as a make coat and deposited abrasive particles as well as articles that have the binder and abrasive particles simultaneously coated on the backing as a slurry coat. Coated abrasive articles that are particularly preferred include articles that have an exposed abrading or abrasive surface that is a textured, three-dimensional surface.

Another embodiment of this invention is a method of marking an abrasive article having a coated, exposed surface by a step of selectively removing a portion of the coated surface, without contaminating that surface, to inscribe a detectable marking. When a laser is used to perform this procedure or process, this method may be used in both batch processes and as well as in continuous processes.

Still another embodiment of this invention is a method of converting an abrasive web into a marked abrasive article in which the abrasive web is cut to a preselected shape and then a portion of an abrasive surface of the web is selectively removed to inscribe a detectable marking without contaminating exposed surfaces of the abrasive article.

Still another embodiment of this invention is a method of converting an abrasive web into a marked abrasive article in which the abrasive web is cut to a preselected shape and simultaneously a portion of an abrasive surface of the web is selectively removed to inscribe a detectable marking without contaminating the abrasive surface of the abrasive article. This conversion method may be achieved either by using a single laser beam having an extremely short delay time between the cutting and marking steps or by using multiple laser beams.

The term "selective removal" as used in this specification includes, but is not limited to cut through, perforated, score or kiss cut and controlled depth cut segments of an abrasive web that is typically a part of or used to make an abrasive article. Cut through means that both the backing and coated surface of an abrasive web or article have been cut so that a segment of an abrasive web that has been cut through may be separated from a main segment of the web. Perforated means that a segment of the coating and backing have been cut through but sufficient abrasive web adjacent or near the cut through segments have been left intact so that the cut segment may not be separate from a main segment(s) of the abrasive web without first pulling about or breaking the intact segment(s) of the web. Score or kiss cut means that the cut extends to a specific layer or depth of the abrasive article without completely penetrating every layer. Typically, this would entail cutting through a coated layer to a liner, but may also include cutting the coated layer to a specific predetermined depth.

The term "contaminating" refers to the presence of debris, swarf, or other foreign material on the exposed surface of an abrasive article and is generally associated with or caused by removing portions of materials or coatings that make up an abrasive article. In particular, to be free of contamination means that the exposed surface of the abrasive article does not include residual material, or material oriented in such a manner that it would detrimentally affect the intended abrading performance of that article.

DETAILED DESCRIPTION

In a preferred embodiment of a process of this invention, a laser beam is used in conjunction with a very precise, high speed beam motion and control system that is used to mark and/or cut stationary or moving substrates. When such a process is used on abrasive products, it allows both the ability to cut parts to desired, finished dimensions and to create marks or other identification features in a single processing step.

Such marks or identification features are very difficult to form using conventional cutting techniques. Conventional cutting of abrasive or abrading surfaces often is uneven or rough, leaves jagged edges or creates a surface that is subject to shelling of binder and abrasive when used. Kerf created by a laser, however, provides a crisp, clearly visible mark on the abrasive surface. Further, conventional cutting processes leave swarf and/or residual material that could contaminate exposed surfaces of a final product. In contrast, material that is removed from an abrading surface using a laser is vaporized and thus removed from the cutting area. This minimizes surface contamination of the articles abrading or abrasive surface.

Figure 3:
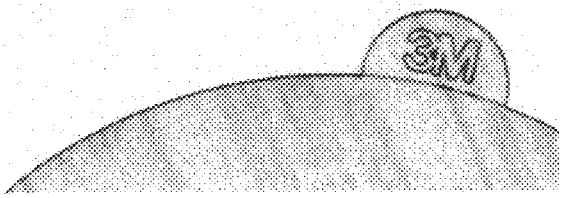
FIG. 3 is a printed, digitized image of an abrasive article having a marked tab.

The present invention may be used to make a variety of marked abrasive articles. The abrading or abrasives surfaces of abrasives articles such as bonded abrasives, coated abrasives as well as nonwoven abrasive articles may all used in the present invention. The present method is readily used to mark differently shaped articles such as round, oval, square, rectangle, triangle, daisies, polygonal, or other regular or irregular shapes, and such articles may also include dust holes, center holes, scalloped edges, or tabs (see, for example, FIG. 3). These many types of articles may also include a detachable tab or other removable portion of the abrasive surface that is marked.

A particularly preferred abrasive surface that is readily marked according to this invention is a microreplicated or structured abrasive product, such as the microreplicated abrasive products sold under the trade designation TRIZACT. TRIZACT abrasives made by Minnesota Mining and Manufacturing Company (3M), St. Paul, Minn. are particularly well suited for applying a marking according to this invention. The precisely shaped, textured, three dimensional abrading surface of these coated abrasive products are readily marked by removing a portion of the slurry coated acrylate-based binder and abrasive particles to give a clear, visible, detectable marking.

Figure 1:
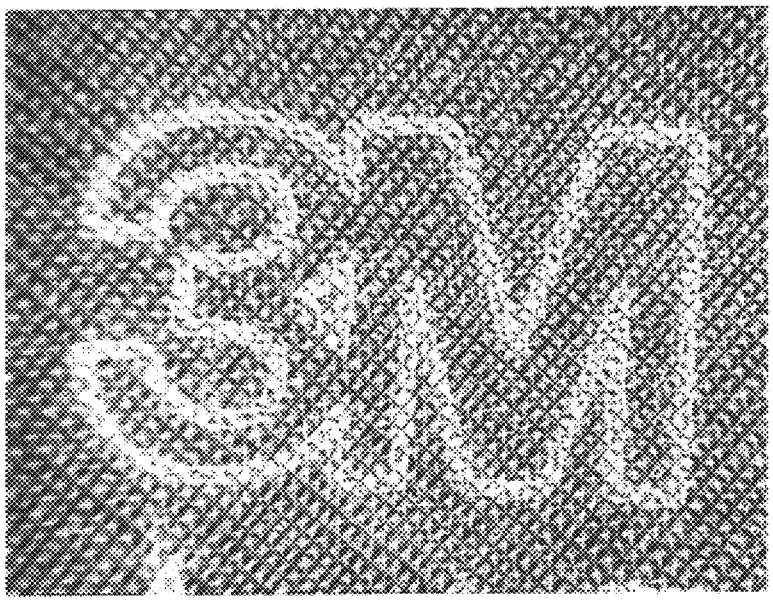
FIG. 1 is a printed, digitized image of marked abrasive disc.
Figure 2:
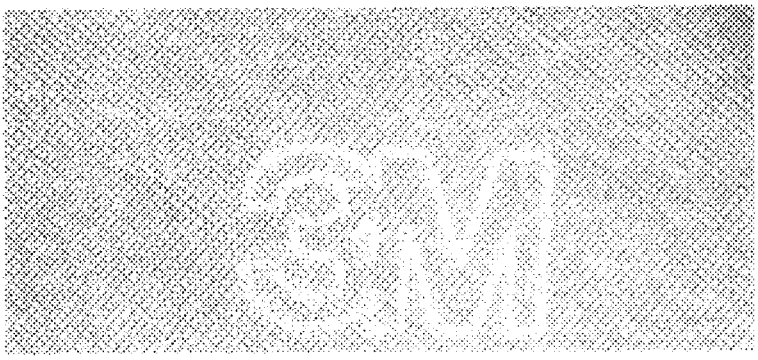
FIG. 2 is a printed, magnified, digitized image of a marked abrasive article.

As illustrated in FIGS. 1 and 2, a structured abrasive discs is readily marked by removing a portion of the abrasive surface using a laser. In the digitized images, the abrasive surface is removed to etch a company trademark. The etched trademark is readily observed to have clear, sharp, smooth edges that do not interfere with the abrasive characteristics or performance of the abrasive disc. Other types of markings are also readily etched onto an abrasive surface according to the present invention. Representative markings or etchings include but are not limited to logos, indicia, numerals, advertisement, grade designations, bar codes, or combinations thereof.

A variety of abrasive articles may be marked according to the method of the present invention. Abrasive articles typically comprise a plurality of abrasive particles adhered by a bond system comprising a binder which can be derived from a binder precursor. Examples of abrasive articles include coated abrasive articles such as lapping or structured abrasive articles, bonded abrasive articles, and nonwoven abrasive articles.

Abrasive articles generally comprise abrasive particles secured within a binder. In a bonded abrasive, the binder bonds the abrasive particles together in a shaped mass. Typically, this shaped mass is in the form of a wheel and is commonly referred to as a grinding wheel. In nonwoven abrasives, the binder bonds the abrasive particles into and/or onto a lofty, open, fibrous substrate. In coated abrasives, the binder bonds the abrasive particles to a substrate or backing.

Coated abrasive articles that may be marked according to the method of this invention may be produced with coatable binder precursor compositions, described herein, on a backing.

A backing for a coated abrasive article may be any number of various materials conventionally used as backings in the manufacture of coated abrasives, such as paper, cloth, film, polymeric foam, vulcanized fibre, woven and nonwoven materials, and the like, or a combination of two or more of these materials or treated versions thereof. The choice of backing material will depend on the intended application of the abrasive article. The strength of the backing should be sufficient to resist tearing or other damage in use, and the thickness and smoothness of the backing should allow achievement of the product thickness and smoothness desired for the intended application.

The backing may also be a fibrous reinforced thermoplastic, for example, as disclosed in U.S. Pat. No. 5,417,726, or an endless spliceless belt, for example, as disclosed in WO 93/12911. The backing may be a polymeric substrate having projecting hook stems, for example, as disclosed in WO 95/19242. Similarly, the backing may be a loop fabric, for example, as described in WO 95/11111.

The backing may be smooth, textured, or perforated and may have a thickness ranging generally from about 6 to about 10,000 micrometers, typically from 6 to 1000 micrometers.

The backing may comprise a polymeric film, cloth, paper sheet, treated versions thereof, a screen made from plastic or metal, and treated or untreated combinations thereof In some applications it is also preferable that the backing be waterproof The thickness of the backing should be sufficient to provide the strength desired for the intended application; nevertheless, it should not be so thick as to affect the desired flexibility in the coated abrasive product. The film backing may be made from a thermoplastic material such as polyamides (nylon), polyester, polypropylene, polyethylene, polyurethane, combinations thereof, and the like. The film backing may also be a microvoided film backing. As used herein "microvoided" means that the film has internal porosity. One example is a microvoided polyester (preferably polyethylene terephthalate) film having a thickness ranging from 0.01 mm to 0.25 mm, more preferably 0.05 mm. Another example is a microvoided polyester film commercially available from ICI Limited, United Kingdom under the trade designation "475/200 MELINEX MV". The film backings may be primed or unprimed. The backing may also be a laminate of paper/film, two polymeric films, paper/cloth film, film/nonwoven material, and the like.

In some instances it may be preferable to have an integrally molded backing, that is a backing directly molded adjacent the abrasive surface. The backing may be molded from either thermal or radiation curable thermoplastic or thermosetting resins. Examples of typical and preferred thermosetting resins include phenolic resins, aminoplast resins, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins and mixtures thereof. Examples of preferred thermoplastic resins include polyamide resins (for example, nylon), polyester resins and polyurethane resins (including polyurethane-urea resins). One preferred thermoplastic resin is a polyurethane derived from the reaction product of a polyester polyol and an isocyanate.

In certain applications it may be desirable to have a more durable and tear-resistant backing which can be accomplished by the inclusion of a scrim material or the like within the backing. Useful scrim materials generally are lightweight, open-weave coarse fabrics. Suitable materials include metal or wire meshes, fabrics such as cotton, polyester, rayon, glass cloth, or other reinforcing materials such as fibers. The scrim or reinforcing material may be pretreated to increase the adhesion of the resin to the scrim.

Coated abrasive articles may also include lapping abrasive articles and structured abrasive articles. A lapping coated abrasive article comprises a backing having an abrasive coating bonded to the backing. The abrasive coating comprises a plurality of abrasive particles distributed in a binder. In some instances, the binder bonds this abrasive coating to the backing. Alternatively, an additional material may be used to bond the abrasive coating to the backing, which may be selected, for example, from the binder precursors described herein and may be the same or different than the binder precursor used to form the abrasive coating. Generally, the particle size of the abrasive particles used in a lapping abrasives range, on average, from about 0.1 to less than about 200 micrometers, typically, 0. 1 to 120 micrometers. The abrasive coating may have a smooth outer surface or a textured outer surface. The abrasive coating may also further comprise additives as discussed herein.

One method of producing a structure abrasive article comprising abrasive composites uses a production tool or mold containing a plurality of cavities. These cavities are essentially the inverse shape of the desired abrasive composites and are responsible for generating the shape of the abrasive composites. The number of cavities/square unit area results in the abrasive article having a corresponding number of abrasive composites/square unit area. These cavities may have any geometric shape such as a cylinder, dome, pyramid, truncated pyramid, prism, cube, cone, truncated cone or any shape having a top surface cross-section being a triangle, square, circle, rectangle, hexagon, octagon, or the like. The dimensions of the cavities are selected to achieve the desired number of abrasive composites/square unit area. The cavities may be present in a dot like pattern with spaces between adjacent cavities or the cavities may butt up against one another.

An abrasive slurry may be coated into the cavities of the mold by any conventional technique such as die coating, vacuum die coating, spraying, roll coating, transfer coating, knife coating and the like. If the mold comprises cavities that either have flat tops or relatively straight side walls, then it is preferred to use a vacuum during coating to minimize any air entrapment.

The mold may be a belt, a sheet, a continuous sheet or web, a coating roll such as a rotogravure roll, a sleeve mounted on a coating roll, or die and may be composed of metal, including a nickel-plated surface, metal alloys, ceramic, or plastic. Further information on production tools, their production, materials, etc. may be found in U.S. Pat. Nos. 5,152,917 and 5,435,816.

The abrasive slurry is made by combining together by any suitable mixing technique the binder precursor, the abrasive particles and the optional additives. Examples of mixing techniques include low shear and high shear mixing, with high shear mixing being preferred. Ultrasonic energy may also be utilized in combination with the mixing step to lower the abrasive slurry viscosity. Typically, the abrasive particles are gradually added into the binder precursor. It is preferred that the abrasive slurry be a homogeneous mixture of binder precursor, abrasive particles and optional additives. If necessary, water and/or solvent may be added to lower the viscosity. The amount of air bubbles in the abrasive slurry may be minimized by pulling a vacuum either during or after the mixing step. In some instances it is preferred to heat, generally in the range from about 30° C. to about 100° C., the abrasive slurry to lower the viscosity. It is important the abrasive slurry be monitored before coating to ensure a rheology that coats well and in which the abrasive particles and other fillers do not settle before coating.

When the abrasive slurry comprises a thermosetting binder precursor, the binder precursor is cured or polymerized. This polymerization is generally initiated upon exposure to an energy source. In general, the amount of energy depends upon several factors such as the binder precursor chemistry, the dimensions of the abrasive slurry, the amount and type of abrasive particles and the amount and type of the optional additives. Radiation energy is one preferred energy source. The radiation energy sources include electron beam, ultraviolet light, or visible light.

Other details on the use of a production tool to make coated abrasive articles is further described in U.S. Pat. Nos. 5,152,917; 5,435,816; 5,833,724; 5,840,088; and 5,863,306.

The abrasive article may be converted into any desired shape or form. This converting may be accomplished by slitting, die cutting, or any suitable means. Then a detectable marking is etched on the abrasive article by the method of this invention. The converting may also be accomplished simultaneously with etching of the detectable marking by this invention.

The different types of coated abrasive articles may contain a peripheral coating which overlays the binder and abrasive particles of the abrasive article. For example, the peripheral coating may overlay a size coat, an abrasive coating, or abrasive composites. This coating is commonly referred to as a supersize coat for coated abrasive articles having make and size coats. The supersize may contain a grinding aid such as sodium chloride, potassium cryolite, sodium cryolite, ammonium cryolite, potassium tetrafluoroborate, sodium tetrafluoroborate, silicon fluorides, potassium chloride, magnesium chloride, or an anti-loading agent such as metallic stearates, metal salts of fatty acids, urea-formaldehyde resins, waxes, mineral oils, crosslinked silanes, crosslinked silicones, fluorochemicals, metallic alkyl phosphates, phosphonic acids, metallic alkyl phosphonates, metallic alky sulfates, and salts of alkyl amines. These grinding aid are further described in U.S. Pat. Nos. 5,954,844; 2,768,886; 2,893,854; 3,619,150; 4,988,554; 4,396,403; 4,973,338; and 5,164,265.

In some instances, it may be preferred to incorporate a pressure sensitive adhesive onto the back side of the coated abrasive such that the resulting coated abrasive can be secured to a back up pad. Representative examples of pressure sensitive adhesives suitable for this invention include latex crepe, rosin, acrylic polymers and copolymers e.g., polybutylacrylate, polyacrylate ester, vinyl ethers, e.g., polyvinyl n-butyl ether, alkyd adhesives, rubber adhesives, e.g., natural rubber, synthetic rubber, chlorinated rubber, and mixtures thereof. A preferred pressure sensitive adhesive is an isooctylacrylate:acrylic acid copolymer.

Alternatively, the coated abrasive may contain a hook and loop type fastener or attachment system to secure the coated abrasive to the back up pad. The loop fabric may be on the back side of the coated abrasive with hooks on the back up pad. Alternatively, the hooks may be on the back side of the coated abrasive with the loops on the back up pad.

This hook and loop type attachment system is further described in U.S. Pat. Nos. 4,609,581; 5,254,194, International Application WO 95/19242 and U.S. patent application Ser. No. 08/181,192. For example, a make coat precursor may be coated directly onto a loop fabric, which may be a chenille stitched loop, a stitchbonded loop, or a brushed loop, for example, brushed nylon. The loop fabric may also contain a sealing coat to seal the loop fabric and prevent the make coat precursor from penetrating into the loop fabric. In this arrangement, the loop fabric can releasably engage with hooking stems present on a support pad. The binder precursor may also be coated directly on a hooking stem substrate, which generally comprises a substrate having a front and back surface. The binder precursor may then be applied to the front surface of the substrate, the hooking stems protruding from the back surface. In this arrangement, the hooking stems can releasably engage with a loop fabric present on a support pad.

The coated abrasive may be in the form of a roll of abrasive discs, as described in U.S. Pat. No. 3,849,949.

The coated abrasive may be converted into a variety of different shapes and forms such as belts, discs, square, rectangle, triangle, polygon, sheets, tapes, daisies and the like. Belts may contain a splice or a joint, alternatively the belts may be spliceless such as that taught by in WO 93/12911. The belt width may range from about 0.5 cm to 250 cm, typically anywhere from about one cm to 150 cm. The belt length may range from about 5 cm to 1000 cm, typically 10 cm to 500 cm. The belt may have straight or scalloped edges. The discs may contain a center hole or have no center hole. Discs may have the following shapes: round, oval, octagon, pentagon, hexagon or the like; all of these converted forms are well known in the art. The discs may also contain dust holes, typically for use with a tool containing a vacuum source. The diameter of the disc may range from about 0.1 cm to 1500 cm, typically from one cm to 100 cm. Sheets may be square, triangular, or rectangular. The width ranges from about 0.01 cm to 100 cm, typically 0.1 cm to 50 cm. The length ranges from about one cm to 1000 cm, typically 10 cm to 100 cm.

It is also feasible to adhere the abrasive particles to both a major or working surface and the opposite surface of a backing. The abrasive particles can be the same or different from one another. In this aspect, the abrasive article is essentially two sided; one side can contain a plurality of abrasive particles which are different from a plurality of abrasive particles on the other side. Alternatively, one side can contain a plurality of abrasive particles having a different particle size than those on the other side. In some instances, this two sided abrasive article can be used in a manner in which both sides of the abrasive article abrade at the same time. For example, in a small area such as a corner, one side of the abrasive article can abrade the top workpiece surface, while the other side can abrade the bottom workpiece surface.

Marked, nonwoven abrasive articles include an open, lofty fibrous substrate having a binder which binds fibers at points where they contact. Optionally, abrasive particles or nonabrasive particles (such as fillers) may be adhered to the fibers by the binder if the manufacturer desires. Nonwoven abrasives are described generally in U.S. Pat. Nos. 2,958,593 and 4,991,362.

Marked, bonded abrasive articles comprise a binder which adheres abrasive particles together in the form of a molded product. Bonded abrasives are described generally in U.S. Pat. No. 4,800,685.

Binders typically used in abrasive articles are often formed from a binder precursor. The binder precursor comprises a resin that is in an uncured or unpolymerized state. During the manufacture of the abrasive article, the resin in the binder precursor is polymerized or cured, such that a binder is formed. The binder precursor may comprise a condensation curable resin, an addition polymerizable resin, a free radical curable resin and/or combinations and blends of such resins.

One preferred binder precursor is a resin or resin mixture that polymerizes via a free radical mechanism. The polymerization process is initiated by exposing the binder precursor, along with an appropriate catalyst, to an energy source such as thermal energy or radiation energy. Examples of radiation energy include electron beam, ultraviolet light or visible light.

Examples of free radical curable resins include acrylated urethanes, acrylated epoxies, acrylated polyesters, ethylenically unsaturated monomers, aminoplast monomers having pendant unsaturated carbonyl groups, isocyanurate monomers having at least one pendant acrylate group, isocyanate monomers having at least one pendant acrylate group and mixtures and combinations thereof The term acrylate encompasses acrylates and methacrylates.

One preferred binder precursor comprises a urethane acrylate oligomer, or a blend of a urethane acrylate oligomer and an ethylenically unsaturated monomer. The preferred ethylenically unsaturated monomers are monofunctional acrylate monomers, difunctional acrylate monomers, trifunctional acrylate monomers or combinations thereof The binder formed from these binder precursors provides the abrasive article with its desired properties.

Examples of commercially available acrylated urethanes include those known by the trade designations "PHOTOMER" (for example, "PHOTOMER 6010") from Henkel Corp. Hoboken, N.J.; EBECRYL 220 (hexafunctional aromatic urethane acrylate of molecular weight 1000), "EBECRYL 284" (aliphatic urethane diacrylate of 1200 molecular weight diluted with 1,6-hexanediol diacrylate), "EBECRYL 4827" (aromatic urethane diacrylate of 1600 molecular weight), "EBECRYL 4830" (aliphatic urethane diacrylate of 1200 molecular weigh diluted with tetraethylene glycol diacrylate), "EBECRYL 6602" (trifunctional aromatic urethane acrylate of 1300 molecular weight diluted with trimethylolpropane ethoxy triacrylate), and "EBECRYL 840" (aliphatic urethane diacrylate of 1000 molecular weight) from UCB Radcure Inc. Smyrna, Ga.; "SARTOMER" (for example, "SARTOMER 9635, 9645, 9655, 963-B80, 966-A80", etc.) from Sartomer Co., West Chester, Pa., and "UVITHANE" (for example, "UVITHANE 782") from Morton International, Chicago, Ill.

The ethylenically unsaturated monomers or oligomers, or acrylate monomers or oligomers, may be monofunctional, difunctional, trifunctional or tetrafunctional or even higher functionality. The term acrylate includes both acrylates and methacrylates. Ethylenically unsaturated monomers or oligomers preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like.

Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated monomers or oligomers include monoallyl, polyallyl, and polymethallyl esters and amides of carboxylic acids, such as diallyl phthalate, diallyl adipate, and N,N-diallyladipamide. Still other nitrogen containing compounds include tris(2-acryl-oxyethyl)isocyanurate, 1,3,5-tri(2-methacryloxyethyl)-s-triazine, acrylamide, methylacrylamide, N-methyl-acrylamide, N,N-dimethylacrylamide, N-vinyl-pyrrolidone, and N-vinylpiperidone, and "CMD 3700", available from Radcure Specialties. Examples of ethylenically unsaturated diluents or monomers may be found in U.S. Pat. Nos. 5,236,472 and 5,580,647.

In general the ratio between these acrylate monomers depends upon the weight percent of abrasive particles and any optional additives or fillers desired in the final abrasive article. Typically, these acrylate monomers range from about 5 parts by weight to about 95 parts by weight urethane acrylate oligomer to about 5 parts by weight to about 95 parts by weight ethylenically unsaturated monomer.

Acrylated epoxies are diacrylate esters of epoxy resins, such as the diacrylate esters of bisphenol A epoxy resin. Examples of commercially available acrylated epoxies include those having the trade designations "CMD 3500", "CMD 3600", and "CMD 3700", available from Radcure Specialties, and "CN103", "CN104", "CN111", "CN112", and "CN114", commercially available from Sartomer, West Chester, Pa.

Examples of polyester acrylates include "PHOTOMER 5007" and "PHOTOMER 5018", commercially available from Henkel Corporation, Hoboken, N.J.

Aminoplast monomers have at least one pendant alpha, beta-unsaturated carbonyl group. These unsaturated carbonyl groups may be acrylate, methacrylate or acrylamide type groups. Examples of such materials include N-(hydroxymethyl)-acrylamide, N,N'-oxydimethylenebisacrylamide, ortho and para acrylamidomethylated phenol, acrylamidomethylated phenolic novolac and combinations thereof. These materials are further described in U.S. Pat. Nos. 4,903,440 and 5,236,472.

Isocyanurates having at least one pendant acrylate group and isocyanate derivatives having at least one pendant acrylate group are further described in U.S. Pat. No. 4,652,274. The preferred isocyanurate material is a triacrylate of tris(hydroxy ethyl) isocyanurate.

Depending upon how the free radical curable resin is cured or polymerized, the binder precursor may further comprise a curing agent, (which is also known as a catalyst or initiator). When the curing agent is exposed to the appropriate energy source, it will generate a free radical source that will start the polymerization process.

Another binder precursor comprises an epoxy resin. Epoxy resins have an oxirane ring and are polymerized by a ring opening reaction. Such epoxide resins include monomeric epoxy resins and polymeric epoxy reins. Examples of some preferred epoxy resins include 2,2-bis-4-(2,3-epoxypropoxy)-phenyl)propane, a diglycidyl ether of bisphenol, commercially available materials under the trade designation "EPON 828", "EPON 1004", and "EPON 1001F", commercially available from Shell Chemical Co., and "DER-331", "DER-332", and "DER-334", commercially available from Dow Chemical Co. Other suitable epoxy resins include cycloaliphatic epoxies, glycidyl ethers of phenol formaldehyde novolac (for example, "DEN-431" and "DEN-428"), commercially available from Dow Chemical Co. The blend of free radical curable resins and epoxy resins are further described in U.S. Pat. Nos. 4,751,138 and 5,256,170.

The binder precursor may also be a phenolic resin (resole or novolac), urea-formaldehyde resin, melamine formaldehyde resin and the like. The ratio between abrasive particles and these types of binder precursors may vary to the desired end application. This ratio may be between 1:10 to 5:1 parts binder to abrasive particles, typically the ratio is between 1:5 to 5:1.

It may be preferred in some instances to form the abrasive article by use of make and size coatings. In these abrasive article embodiments, a make coating is applied to a backing, the abrasive particles are applied to the backing, the make coating is exposed to conditions to at least partially cure the make coating, and a size coating is applied over the abrasive particles and make coating. The structure is then subjected to conditions sufficient to cure the make and size coatings. Optional presize and supersize coatings may also be applied.

The abrasive articles typically include a plurality of abrasive particles. The term "abrasive particles" also includes single abrasive particles bonded together by a binder to form an abrasive composite or agglomerate. Abrasive agglomerates are further described in U.S. Pat. Nos. 4,311,489; 4,652,275; and 4,799,939. The abrasive particle may further comprise a surface treatment or coating, such as a coupling agent or metal or ceramic coatings.

Examples of abrasive particles include fused aluminum oxide, ceramic aluminum oxide, heated treated aluminum oxide, silicon carbide, titanium carbide, silica, zirconia, alumina zirconia, iron oxide, diamond (natural and synthetic), ceria, cubic boron nitride, garnet and combinations thereof The average particle size of the abrasive particles ranges from about 0.1 to 1000 microns, typically 0.1 to 500 microns, preferably 0.1 to 100 microns, and most preferably 0.1 to 50 microns.

The abrasive coating and the backing of this invention may further include optional additives, such as, abrasive particle surface modification additives, coupling agents, fillers, expanding agents, fibers, antistatic agents, curing agents, suspending agents, photosensitizers, lubricants, wetting agents, surfactants, pigments, dyes, UV stabilizers, and anti-oxidants. The amounts of these materials are selected to provide the properties desired.

A coupling agent may provide an association bridge between the binder and the abrasive particles. Additionally the coupling agent may provide an association bridge between the binder and the filler particles. Examples of coupling agents include silanes, titanates, and zircoaluminates. There are various means to incorporate the coupling agent. For example, the coupling agent may be added directly to the binder precursor. The abrasive coating may contain anywhere from about 0 to 30%, preferably between 0.1 to 25% by weight coupling agent. Alternatively, the coupling agent may be applied to the surface of the filler particles or the abrasive particles. The abrasive particle may contain anywhere from about 0 to 3% by weight coupling agent, based upon the weight of the abrasive particle and the coupling agent. Example of a commercial coupling agent is an isopropyl triisosteroyl titanate commercially available from Kenrich Petrochemicals, Bayonne, N.J., under the trade designation "KR-TTS".

The abrasive coating may further optionally comprise a filler. A filler is a particulate material and generally has an average particle size range between 0.1 to 50 micrometers, typically between 1 to 30 micrometers. Examples of useful fillers for this invention include: metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate, lithium silicate, and potassium silicate) metal sulfates (such as calcium sulfate, barium sulfate, sodium sulfate, aluminum sodium sulfate, aluminum sulfate), gypsum, vermiculite, wood flour, aluminum trihydrate, carbon black, metal oxides (such as calcium oxide (lime), aluminum oxide, tin oxide (for example stannic oxide), titanium dioxide) and metal sulfites (such as calcium sulfite), thermoplastic particles (polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles) and the like. The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron titanium. Other miscellaneous fillers include sulfur, organic sulfur compounds, graphite and metallic sulfides.

An example of a suspending agent is an amorphous silica particle having a surface area less than 150 meters square/gram that is commercially available from DeGussa Corp., Ridgefield Park, N.J., under the trade name "OX-50". The addition of the suspending agent may lower the overall viscosity of the abrasive slurry. The use of suspending agents is further described in U.S. Pat. No. 5,368,619.

The binder precursor may further comprise a curing agent. A curing agent is a material that helps to initiate and complete the polymerization or crosslinking process such that the binder precursor is converted into a binder. The term curing agent encompasses initiators, photoinitiators, catalysts and activators. The amount and type of the curing agent will depend largely on the chemistry of the binder precursor.

Polymerization of ethylenically unsaturated monomer(s) or oligomer(s) occurs via a free-radical mechanism. If the energy source is an electron beam, the electron beam generates free-radicals which initiate polymerization. If the energy source is heat, ultraviolet light, or visible light, an initiator may have to be present in order to generate free-radicals. Examples of initiators (that is, photoinitiators) that generate free-radicals upon exposure to ultraviolet light or heat include, but are not limited to, organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof An example of a commercially available photoinitiator that generates free radicals upon exposure to ultraviolet light include those having the trade designation "IRGACURE 651" and "IRGACURE 184", commercially available from the Ciba Geigy Company, Hawthorne, N.J., and "DAROCUR 1173", commercially available from Merck. Examples of initiators that generate free-radicals upon exposure to visible light may be found in U.S. Pat. No. 4,735,632. Another photoinitiator that generates free-radicals upon exposure to visible light has the trade name "IRGACURE 369", commercially available from Ciba Geigy Company.

Typically, the initiator is used in amounts ranging from 0.1 to 10%, preferably 2 to 4% by weight, based on the weight of the binder precursor. Additionally, it is preferred to disperse, preferably uniformly disperse, the initiator in the binder precursor prior to the addition of any particulate material, such as the abrasive particles and/or filler particles.

The following examples illustrate specific embodiments of the present invention. These examples are not intended to limit the invention that is defined in the attached claims.

EXAMPLES

Example 1

Marked Abrasive Product

Example 1 Laser Marking an Abrasive Disc

A computer controlled digital converting workstation (Lasersharp LPM 1000) commercially available from LASX Industries, White Bear Lake, Minn., was used for the marking of coated abrasive discs. The following parameters were set for marking abrasive discs by the digital converting workstation. The laser beam speed was 1000 mm/s. The frequency was 5 Khz at 12% duty cycle. The average power was 105 watts. The jump speed was 500 mm/s. The jump delay was 5000 microsecond. The on delay was 800 microsecond. The mark delay was 2000 microsecond. The off delay was 1200 microsecond. The poly delay was 150 microsecond. The focus spot size was 310 microns. The field of view was 350 mm×350 mm. The focus standoff was 366 mm.

The "3M" trademark (a trademark of the Minnesota Mining and Manufacturing Company, St. Paul, Minn.) was scanned into the computer, which controls the digital converting workstation. The 3M trademark was then converted into a digitized image that would be marked on the abrasive discs. A 5" grade A45 abrasive disc (TR8 ZACT Abrasives 3M 227AA abrasive disc, commercially available from 3M, St. Paul, Minn.) was centered under the processing field of the digital converting workstation. The start button was pushed and a 3M trademark was marked on the TRIZACT Abrasives 3M 227AA abrasive disc, as shown in FIG. 1.

Example 2

Laser Marking and Cutting an Abrasive Disc

A computer controlled digital converting workstation (Lasersharp LPM 1000) commercially available from LASX Industries, White Bear Lake, Minn., was used for cutting and marking a coated abrasive disc. A piece of 8"×8" abrasive web, the web comprises a X weight backing with three-dimensional composites containing alumina and a grinding aid, that is used to form converted TRIZACT Abrasives 3M 227AA abrasive disc (commercially available from 3M), was placed under the processing field of the digital converting workstation. The following parameters were set for cutting out a 5" abrasive disc from the 8"×8" abrasive web by the digital converting workstation. The laser beam speed was 600 mm/s.

The frequency was 10 Khz at 100% duty cycle. The power was 1000 watts. The jump speed was 5000 mm/s. The jump delay was 5000 microsecond. The on delay was 400 microsecond. The mark delay was 2000 microsecond. The off delay was 1700 microsecond. The poly delay was 400 microsecond. The focus spot size was 310 microns. The field of view was 350 mm×350 mm. The focus standoff was 366 mm. The start button was pushed and the 5" abrasive disc was cut out from the 8"×8" abrasive web. A 3M logo was marked on the 5" disc as described in Example 1.

What is claimed is:

1. A coated abrasive article comprising a backing, an exposed surface of a coating containing abrasive particles attached to the backing and a detectable marking inscribed on the abrasive article, wherein at least part of the coating is selectively removed from a portion of the exposed surface of the coating, without contamination of the exposed surface, to inscribe the detectable marking on the abrasive article.

2. The coated abrasive article of claim 1 wherein the coating comprises a binder and abrasive particles that are sequentially attached to the backing as a make coat and deposited abrasive particles.

3. The coated abrasive article of claim 1 wherein the coating comprises a binder and abrasive particles that are abrasive composites.

4. The coated abrasive of claim 3 wherein the binder is crosslinked acrylate polymer.

5. The coated abrasive article of claim 3 wherein the exposed surface is a textured, three dimensional surface.

6. The coated abrasive article of claim 5 wherein the exposed surface is precisely shaped.

7. The coated abrasive article of claim 1 wherein the backing and the coating containing abrasive particles are contrasting colors.

8. The coated abrasive article of claim 1 wherein the detectable marking is visible.

9. The coated abrasive article of claim 1 wherein the detectable marking is machine readable.

10. A method of marking an abrasive article having a coated, exposed surface comprising a binder and abrasive particles wherein the method comprises the step of selectively removing a portion of the coated surface without contaminating the exposed surface of the abrasive article to inscribe a detectable marking.

11. The method of claim 10 wherein the removing step is performed with a laser.

12. The method of claim 10 wherein the removing step occurs as the coated surface is continuously moved past a laser.

13. The method of claim 10 wherein the detectable marking is visible.

14. The method of claim 10 wherein the detectable marking is machine readable.

15. The method of claim 10 wherein the coated surface comprises a binder and abrasive particles that are sequentially attached to a backing as a make coat and deposited abrasive particles.

16. The method of claim 10 wherein the coated surface comprises a binder and abrasive particles that are simultaneously attached to a backing as slurry.

17. The method of claim 16 wherein the coated surface is a textured, three-dimensional surface.

18. The method of claim 17 wherein the coated surface is precisely shaped.

19. A method of converting an abrasive web into a marked abrasive article having a coated, exposed abrasive surface, wherein the method comprises the steps of cutting the abrasive web to a preselected shape and selectively removing a portion of the coated surface without contaminating the exposed surface of the abrasive article to inscribe a detectable marking.

20. An abrasive article comprising an inscribed detectable marking and an exposed surface of a composite coating containing abrasive particles, wherein at least part of the coating is selectively removed from a portion of the exposed surface of the composite coating, without contamination of the exposed surface, to inscribe the detectable marking on the abrasive article.

* * * * *

UNITED STATES PATENT AND TRADEMARK OFFICE

CERTIFICATE OF CORRECTION

PATENT NO. : 6,287,184 B1
DATED : September 11, 2001
INVENTOR(S) : Carpentier, Louis R.

It is certified that error appears in the above-identified patent and that said Letters Patent is hereby corrected as shown below:

Column 1,
Line 62, “article, Suitable” should read -- article. Suitable --;

Column 4,
Line 36, “thereof In” should read -- thereof. In --;
Line 38, “proof The” should read -- proof. The --;

Column 8,
Line 28, “thereof The” should read -- thereof. The --;
Line 35, “thereof The” should read -- thereof. The --;
Line 47, “weigh” should read -- weight --;

Column 10,
Line 44, “thereof” should read -- thereof. --; and

Column 11,
Line 67, “thereof An” should read -- thereof. An --.

Signed and Sealed this

Fourteenth Day of January, 2003

JAMES E. ROGAN
*Director of the United States Patent and Trademark Office*